US005307991A

United States Patent [19]

Hanson et al.

[11] Patent Number: 5,307,991

[45] Date of Patent: May 3, 1994

[54] FUEL INJECTOR AND METHOD OF MANUFACTURING

[75] Inventors: Scott A. Hanson, Ypsilanti; James L. Creehan, Livonia; John C. Hickey, Ypsilanti, all of Mich.

[73] Assignee: Ford Motor Company, Dearborn, Mich.

[21] Appl. No.: 594,753

[22] Filed: Oct. 9, 1990

[51] Int. Cl.[5] ..... F02M 51/00

[52] U.S. Cl. ..... 239/1; 239/585.5; 239/600; 251/129.15; 251/129.21

[58] Field of Search ..... 239/585, 600, 1, 5; 251/129.15, 129.21

[56] References Cited

U.S. PATENT DOCUMENTS

| | | | |
|---|---|---|---|
| 2,856,218 | 10/1958 | Helsel . | |
| 3,107,417 | 10/1963 | Jaquish, Jr. et al. . | |
| 3,255,521 | 6/1966 | Callahan, Jr. . | |
| 3,406,912 | 10/1968 | Claffey | 239/600 |
| 3,468,008 | 9/1969 | Barber . | |
| 3,623,370 | 11/1971 | Busch et al. . | |
| 3,706,133 | 12/1972 | Gleeson . | |
| 3,791,591 | 2/1974 | Hedges . | |
| 4,007,880 | 2/1977 | Hans et al. | 239/600 |
| 4,106,170 | 8/1978 | Schoeneweis . | |
| 4,230,273 | 10/1980 | Claxton et al. | 239/600 |
| 4,590,911 | 5/1986 | Sciotti et al. . | |
| 4,753,393 | 6/1988 | Sausner | 239/585 |
| 4,832,522 | 5/1989 | Thayer et al. . | |

FOREIGN PATENT DOCUMENTS

| | | |
|---|---|---|
| 0388494 | 9/1990 | European Pat. Off. . |
| 90/04098 | 4/1990 | World Int. Prop. O. . |

OTHER PUBLICATIONS

Webster's II New Riverside University Dictionary ©1984 by Houghton Mifflin Company, p. 875.

*Primary Examiner*—Andres Kashnikow
*Assistant Examiner*—Karen B. Merritt
*Attorney, Agent, or Firm*—Jerome R. Drouillard; Clifford L. Sadler

[57] ABSTRACT

A fuel injector for an internal combustion engine includes a preassembled permanently mated needle and valve body group contained in a main housing assembly. The valve body group is assembled so that the maximum allowable stroke of the needle is established by a stop abutment, which is permanently attached to the valve body. An injector assembled according to the present method does not require the use of various shims in order to set the air gap. Moreover, precision grinding is not needed to establish the needle lift.

13 Claims, 2 Drawing Sheets

FUEL INJECTOR AND METHOD OF MANUFACTURING

BACKGROUND OF THE INVENTION

1. Field of the Invention

The present invention relates to a fuel injector for an internal combustion engine and to a method for manufacturing such injector.

2. Disclosure Information

The manufacturing of fuel injection nozzles for internal combustion engines has historically been marked by the use of time consuming and laborious grinding, fitting and lapping operations. For example, the needles of fuel injectors are typically ground and lapped to fit into the valve bodies of the injectors. In some cases, the parts are ground separately and then fitted according to their finished sizes. In either event, it is necessary that the mated valve body and injector needle be handled as a unit due to the lack of interchangeability of parts.

U.S. Pat. No. 3,468,008 to Barber and U.S. Pat. No. 3,791,591 to Hedges disclose fuel injectors having traditional designs in which the needle is separable from the valve body. Because both components must be handled as a unit, special processing procedures which add to the cost of manufacturing must be used. According to the present invention, a fuel injector valve unit is assembled by permanently mating a valve needle to a valve body by caging the needle to the body in the manner shown herein. Because the needle, once caged to the valve body, is permanently attached thereto, no special handling is required to assure that the parts do not become mismatched after the needle and valve body have been mated.

A method according to another aspect of the present invention is intended to further reduce the cost of producing fuel injectors by eliminating the need for lift grinding during the manufacturing of such injectors. Lift grinding is a process by which the stroke of the injector is set. Lift grinding involves the use of relatively large grinding machines and delicate measuring equipment to measure, grind and establish a desired distance between a control surface on the valve body and a control surface on the valve's needle. Unfortunately, problems abound with this method of manufacturing. For example, the large size of the grinding machines renders fine tolerances difficult to achieve. This in turn causes uncertainties and variabilities in the stroke of the injectors.

According to conventional techniques, the desired air gap setting between the injector's armature and corresponding magnetic pole piece is established by measuring the dimensions of actual injector subassemblies and by performing calculations using the measured values to determine the thickness of a stop plate which functions as a shim to space the valve group from either the injector's inlet tube or some other internal abutment structure. This stop plate is selected from a group comprising as many as five dozen or more different thicknesses. Unfortunately, the multiplication of measurement errors plus finite differences in actual and nominal stop plate thicknesses results in large air gap variations. Also, stop plates in conventional injectors may become cocked or tilted such that the surface of the stop plate which contacts the injector needle in its fully opened position is not normal to the central axis of the injector needle. This condition may lead to wear and inaccurate stroke setting of the injector because the stroke can change as the needle wears into the stop plate. This is caused by high unit loading of the needle into the cocked stop plate.

The method and structure of the present invention solves all of the previously described problems with injector manufacturing. Because lift grinding is eliminated, the inaccuracies in stroke setting associated therewith are obviated. Because shims of varying thicknesses are not necessary with the present injector, the injector air gap may be set to the desired value precisely without the associated cumbersome and potentially inaccurate procedures associated with the selection of shims or spacers of different thickness. Accordingly, it is an object of the present invention to provide a method for manufacturing an injector which produces superior results in terms of reducing injector stroke and air gap variability, ease of manufacturing, and cost of the end item.

Other objects, features and advantages of the present invention will become apparent to those reading this specification.

SUMMARY OF THE INVENTION

A fuel injector for an internal combustion engine according to the present invention includes a main housing assembly and a preassembled, permanently mated needle and valve body group contained within the main housing. The needle and valve body group preferably comprises a valve needle caged within a generally cylindrical hollow valve body by a stop mechanism which establishes the maximum allowable stroke of the needle. The stop mechanism may comprise a collar permanently joined to one end of the valve body and having a radially inwardly extending shoulder forming an abutment for limiting the stroke of the needle. Alternatively, a generally annular washer may be permanently joined to an end of the valve body such that the maximum allowable stroke of the needle is limited by the washer, which serves as a stop abutment. The washer will preferably be telescopically nested within the valve body. Regardless of the type of stop abutment employed with a valve group according to the present invention, the valve body will be a generally cylindrical hollow structure having an orifice and seat at one end which cooperates with the needle enclosed in the valve body to control the flow of fuel discharged from the injector.

According to another facet of the present invention, a method for constructing a permanently mated needle and valve body group for a fuel injector of an internal combustion engine includes the steps of: placing a valve needle in a valve body; placing a stop abutment washer or collar into or over the valve body such that the washer is resting on a shoulder formed on the needle; positioning the needle a predetermined distance from its closed position in accord with the maximum stroke of the needle while maintaining the washer or collar in flat contact with the needle shoulder; and affixing the stop abutment to the valve body so as to both determine the maximum stroke of the needle and to prevent the needle from disengaging from the valve body. The stop abutment is preferably permanently affixed to the valve body.

Another aspect of the present invention is concerned with a method of assembling an electromagnetic fuel injector for an internal combustion engine comprising the steps of: preassembling a valve body and injector needle into a valve group including a stop abutment and an armature attached to the needle; inserting the valve group into the main housing assembly of the injector and positioning the valve group such that the injector needle is in its maximum stroke position with the armature separated from a corresponding magnetic pole piece by a desired air gap distance; and fixing the valve body in the main housing.

DETAILED DESCRIPTION OF THE PREFERRED EMBODIMENTS

Figure 1:
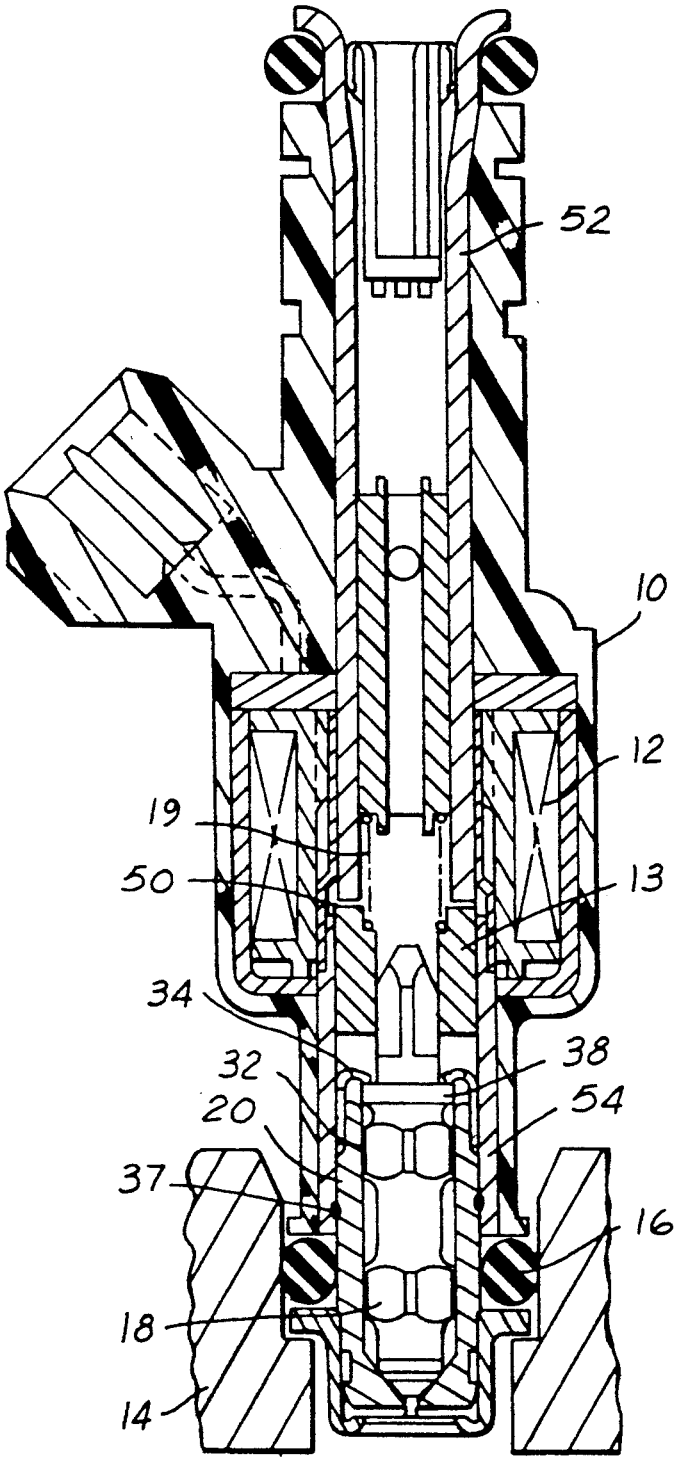
FIG. 1 is a cross-sectional view showing an injector according to the present invention mounted within the intake manifold of an internal combustion engine.

As shown in FIG. 1, a fuel injector for an internal combustion engine according to the present invention comprises a main housing 10 containing an electromagnetic coil 12 for driving the injector. Metering of the fuel is controlled by a valve group comprising valve needle 18 and valve body 20. The position of needle 18 with respect to valve body 20 is controlled by means of spring 19 and coil 12, which act upon armature 13. Spring 19 urges valve needle 18 into the closed position. On the other hand, coil 12 and armature 13, which cooperate with the lower end of inlet tube 52, urge needle 18 into the open position when coil 12 is energized.

Valve body 20 is contained within lower housing 54 of the injector. One aspect of the present invention includes a method for positioning valve body 20 within lower housing 54 so that the proper air gap 50 may be maintained between the lower end of inlet tube 52 and armature 13 when valve needle 18 is in the fully opened position.

An injector according to the present invention, as shown in FIG. 1, may be mounted within the intake manifold of an engine 14, and sealed thereto by means of O-ring 16.

Figure 3:
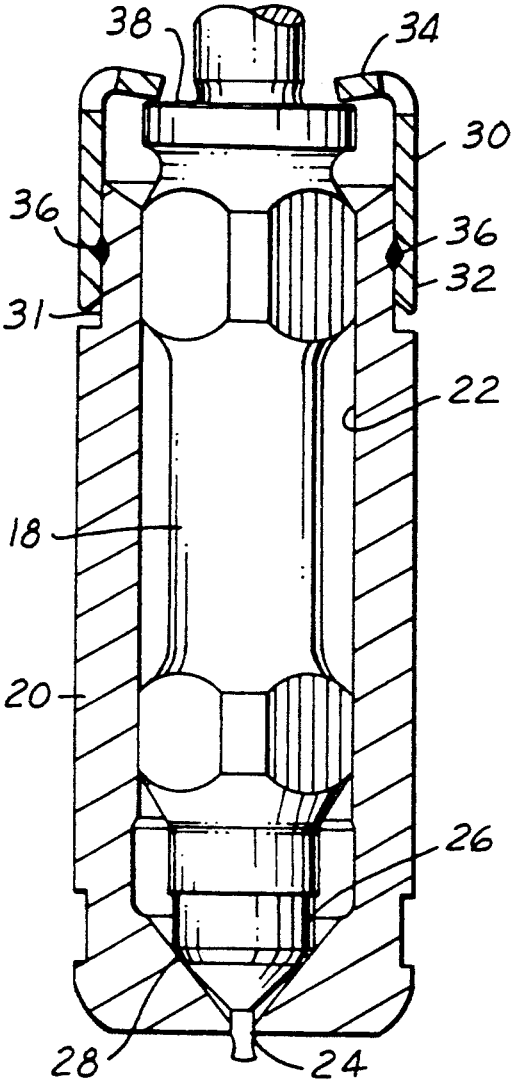
FIG. 3 is a cross-sectional view of a second embodiment of an injector valve group and stop abutment according to the present invention.
Figure 4:
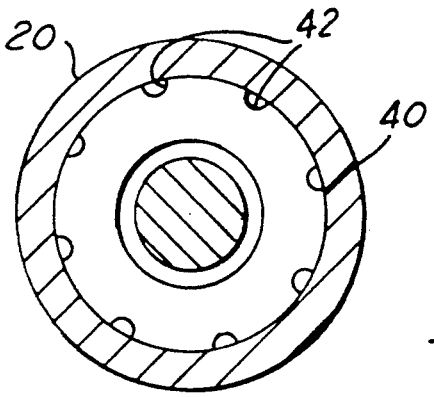
FIG. 4 is a plan view of the injector of FIG. 2, taken along the line 4—4 of FIG. 2. This Figure illustrates a stop abutment of a type useful for the valve group illustrated in FIG. 2.

FIGS. 1 and 3 illustrate one type of injector stop abutment according to the present invention. Another embodiment is shown in FIGS. 2 and 4.

As noted above, FIG. 2 illustrates a first preferred embodiment of injector stop abutment according to the present invention. As shown in this Figure, valve body 20 is a generally cylindrical structure having a cylindrical inner surface 22 defining a void for housing valve needle 18, which is allowed to stroke within valve body 20 to an extent determined by the axial placement of annular washer 40. The annular washer is received telescopically within valve body 20. As can readily be determined from examination of FIG. 2, once annular washer 40 is welded in place within valve body 20, valve needle 18 will be caged permanently within valve body 20. Those skilled in the art will appreciate in view of this disclosure that annular washer 40 could be permanently attached to valve body 20 by means of several alternative processes and techniques known to those skilled in the art and suggested by this disclosure.

Figure 2:
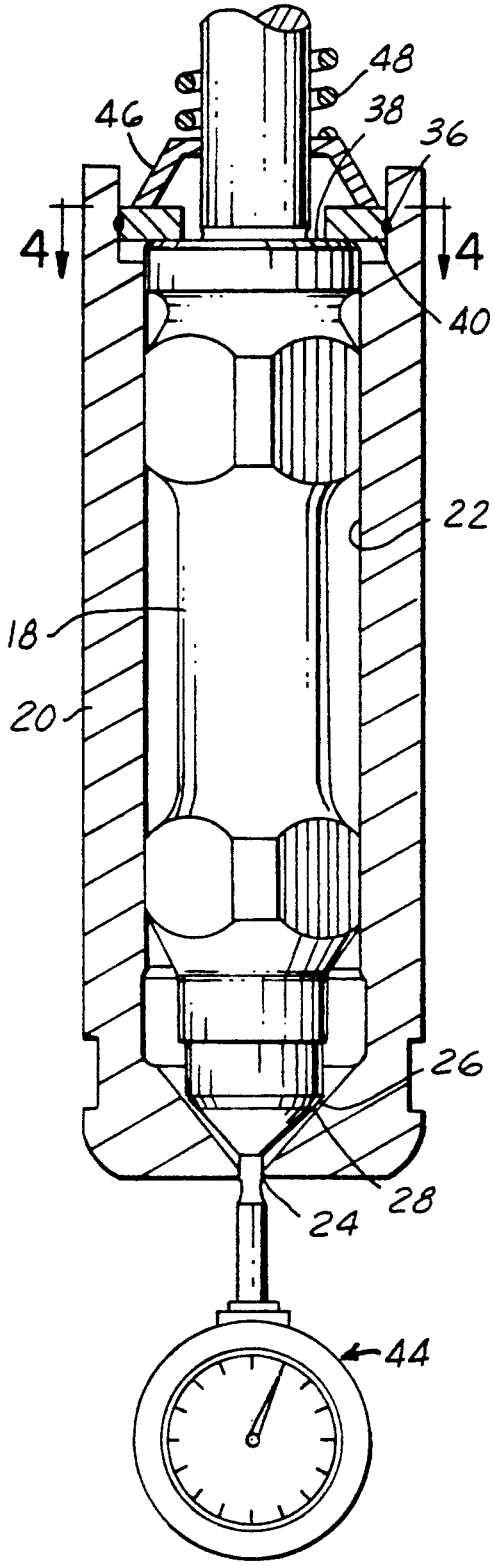
FIG. 2 illustrates a fuel injector valve group according to one embodiment of the present invention and further includes a schematic representation of the method used for establishing the proper location of the injector stop abutment according to an aspect of the present invention.

FIG. 2 illustrates an apparatus and method for constructing an injector valve group according to the present invention. Valve needle 18 contains thereon a needle seat 26 which cooperates with valve body seat 28 to seal the needle and valve body assembly against the flow of fuel at all times except when the valve is opened by the axial pulling of armature 13 and coil 12. The maximum stroke of the needle is determined by the resting distance between the lower face of washer 40 and the upper surface of shoulder 38 located upon valve needle 18.

The apparatus shown schematically in FIG. 2 positions washer 40 with respect to valve body 20 to achieve the desired maximum opening distance for valve needle 18 in the following manner. First, needle positioning fixture 44 is employed for displacing valve needle 18 upwardly the desired maximum opening distance, which may typically be on the order of 50 microns. Those skilled in the art will appreciate in view of this disclosure, of course, that valve body 20 must be held rigidly during the stroke setting process by a fixture (not shown). Once needle positioning fixture 44 has displaced valve needle 18 the desired distance corresponding to the maximum opening position or stroke of the needle, washer 40 may be welded to valve body 20 to produce weld 36, as illustrated in FIG. 2. Note that washer 40 is positioned during the welding operation by means of clamp 46 which is loaded axially downward by means of spring 48. It will thus be appreciated that the action of clamp 46 and spring 48 removes all clearance between the bottom of washer 40 and the top of shoulder 38, while at the same time maintaining even contact between the washer and the shoulder. In this manner, adverse needle wear and stroke changes due to stop plate cocking will be eliminated.

Once washer 40 has been welded to valve body 20, valve needle 18 will be permanently caged within valve body 20 and the resulting valve group cannot be separated thereafter. This provides an aid to the assembly of injectors according to the present invention because once the valve body and valve needle are mated, no special handling need be performed in order to keep the components from becoming separated. FIG. 4 is a plan view of annular washer 40, as well as the injector body and needle, showing with particularity the plurality of radially extending notches, 42, formed in the washer to allow fuel to flow axially past the washer and into the generally annular space formed by valve needle 18 and cylindrical inner surface 22. Those skilled in the art will appreciate in view of this disclosure that as an alternative to needle positioning fixture 44, which pushes upward on needle 18, a fixture could be employed which pulls upward upon the needle.

FIG. 3 illustrates a second valve group according to the present invention. In this embodiment, valve needle 18 is retained within valve body 20 by means of stop collar 30 which comprises a unitary cylindrical cap 32 fitted about reduced diameter section 31 of valve body 20 with the cylindrical cap being integral with radially extending shoulder 34. Stop collar 30 performs the same function with this embodiment as does washer 40 with the previously illustrated embodiment. Moreover, stop collar 30 is installed in a similar fashion by maintaining the stop collar in contact with shoulder 38 while valve needle 18 is lifted off valve body seat 28 a desired distance so that when welded in place with weld 36, the maximum stroke of the needle will be determined and limited by contact of the top surface of shoulder 38 with radially extending shoulder 34.

The embodiments illustrated in FIGS. 2 and 3 are advantageous for several reasons. First, as noted above, a lift grinding process is no longer necessary to establish the desired needle stroke. In conventional processing of injectors having a valve group of the illustrated type, but without an integral stop abutment, a grinder is used to remove material from the top of the valve body until a measured dimension from the top of the valve body to the top of annulus 38 is established. This costly process is not necessary with a valve group according to the present invention. A second advantage arising from the present invention resides in the fact that conventional injectors use a stop plate which is inserted into the housing of the injector during the final assembly of the unit. The stop plate is sandwiched between valve body 20 and a mating surface in the injector housing so that the stop plate assumes the function of stop collar 30 or washer 40 of the present invention. Unfortunately, as noted above, prior art stop plates may on occasion become cocked or twisted in the injector body so that the valve needle will not contact the stop plate about the full circumference of shoulder 38. Rather, the needle in such a situation will contact the stop plate only at a very small area. As a result, valve needle 18 may be subject to bouncing, and also the stroke of the valve needle will change as the needle and stop plate wear into each other. If this should happen, the injector will deliver too much fuel. A valve group according to the present invention will obviate this difficulty by providing a stop abutment which contacts the upper surface of shoulder 38 in a continuous manner without the danger of cocking or twisting of the stop abutment.

The present invention yields yet another benefit during the manufacturing process inasmuch as the integral stop abutments illustrated in FIGS. 2 and 3 obviate the need for a fitting process in connection with the provision of the previously described prior art stop plates. Because prior art stop plates are used not only to retain the needle but also to establish the air gap between armature 13 and the lowest surface of inlet tube 52, known processes require the provision of dozens of various thicknesses of stop plates from which an appropriate thickness may be selected to achieve the desired air gap.

Figure 5:
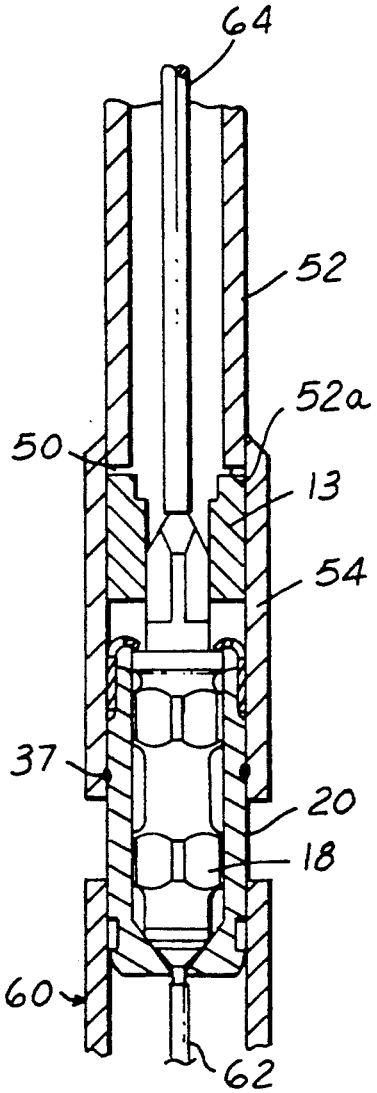
FIG. 5 contains a schematic representation of a method according to the present invention for setting the electromagnetic air gap between the armature and corresponding pole piece of an injector constructed according to the present invention.

The manner in which the need for various thicknesses of stop plates is eliminated is illustrated in FIG. 5. According to this aspect of the present invention, a valve group comprising needle 18 and valve body 20 is secured within lower housing 54 in the following manner. First, ram 62 is employed for bringing armature 13 into contact with lower annular surface **52*a* of inlet tube 52, which comprises the magnetic pole piece corresponding to the armature. Thereafter, while upward pressure is maintained by ram 62 on needle 18, chuck 60 moves valve body 20 and needle 18 in a downward direction as shown in FIG. 5 to bring armature 13 the specified air gap distance—say 50 microns—away from the lower annular surface of inlet tube 52. This distance may be measured by means of probe 64 or by other methods known to those skilled in the art and suggested by this disclosure. When the correct distance has been established between the armature and inlet tube, the valve body will be attached to lower housing 54 by means of weld 37**.

As an alternative to the previously described method for mounting the valve group within the injector housing, a clamp and spring apparatus (not shown) similar to clamp 46 and spring 48 may be employed to urge valve body 20, containing a fully closed needle 18, upwardly until armature 13 is in contact with the lower annular surface **52*a* of inlet tube 52. Then, probe 64 will displace the entire valve group downwardly until a desired distance has been established between armature 13 and annular surface 52*a***. This distance will generally correspond to the sum of the desired air gap at the full open needle position plus the maximum needle stroke distance. At such time as the valve group is properly positioned, the valve body is welded to the injector housing. Using either of the previously described methods, the valve body is attached within the lower housing without the need for any shims of varying thicknesses or, indeed, any shims whatsoever. Accordingly, an injector according to the present invention is ideally suited for ease of manufacturing.

Those skilled in the art will appreciate in view of this disclosure that various changes and modifications may be made to the fuel system componentry and methods described herein without departing from the scope of the invention a defined by the appended claims.

We claim:

1. A fuel injector for an internal combustion engine, comprising:

a main housing assembly; and a preassembled, permanently mated needle and valve body group contained within said main housing, wherein said needle and valve body group comprises a valve needle caged within a generally cylindrical hollow valve body by a stop mechanism comprising a collar permanently joined to one end of said valve body such that the maximum allowable stroke of said needle is limited by said collar.

2. A fuel injector according to claim 1, wherein said collar comprises a generally cylindrical cap extending from one end of said valve body, with said cap having a radially inwardly extending shoulder forming an abutment for limiting the stroke of said needle.

3. A fuel injector according to claim 1, wherein said needle and valve body group further comprises an orifice and seat which cooperate with said needle to control the flow of fuel discharged from said injector.

4. A method for constructing a permanently mated needle and valve body group for a fuel injector of an internal combustion engine, comprising the steps of:

placing a valve needle in a valve body;

positioning said needle a predetermined distance from its closed position, in accord with the maximum stroke of said needle;

placing a stop abutment in contact with a shoulder formed in said needle; and affixing said abutment to said valve body so as to both determine the maximum stroke of said needle and to prevent said needle from disengaging from said valve body.

5. A method according to claim 4 wherein said stop abutment is permanently affixed to said valve body.

6. A method according to claim 4 wherein said stop abutment comprises a generally annular washer telescopically nested within said valve body.

7. A method according to claim 4 wherein said stop abutment comprises a generally cylindrical cap extending from one end of said valve body, with said cap having a radially inwardly extending portion forming an abutment for limiting the stroke of said needle.

8. An electromagnetically operated fuel injector for an internal combustion engine, comprising:

a main housing assembly; and a preassembled, permanently mated needle and valve body group comprising a valve needle caged within a generally cylindrical valve body by a stop mechanism, which, in cooperation with said needle and with an orifice and seat within said body, establishes the maximum allowable fuel flow area for said injector, with said needle and valve body group being contained within said main housing, wherein said stop mechanism comprises a collar permanently joined to one end of said valve body such that the maximum allowable stroke of said needle is limited by said collar.

9. A fuel injector according to claim 8, wherein said collar comprises a generally cylindrical cap extending from one end of said valve body, with said cap having a radially inwardly extending shoulder forming an abutment for limiting the stroke of said needle.

10. A method for assembling an electromagnetic fuel injector for an internal combustion engine, comprising the steps of:

preassembling a valve body and an injector needle into a valve group including an armature attached to said needle;

inserting said valve group into the main housing of said injector and positioning said valve group such that the injector needle is in its maximum stroke position and said armature is separated from a corresponding magnetic pole piece by a desired air gap distance; and fixing said valve body in said main housing.

11. A method according to claim 10 wherein said valve body and said injector needle are permanently mated during said preassembly step.

12. A fuel injector for an internal combustion engine, comprising:

a main housing assembly; and a preassembled, permanently mated needle and valve body group contained within said main housing, wherein said needle and valve body group comprises a valve needle caged within a generally cylindrical hollow valve body by a stop mechanism comprising a generally annular washer permanently joined to one end of said valve body such that the maximum allowable stroke of said needle is limited by said washer.

13. A fuel injector according to claim 12, wherein said washer is telescopically nested within said valve body such that said washer forms an abutment for limiting the stroke of said needle.

* * * * *